US006736651B2

(12) United States Patent
Ho

(10) Patent No.: US 6,736,651 B2
(45) Date of Patent: May 18, 2004

(54) ELECTRICAL CONNECTOR

(75) Inventor: Yi-Tse Ho, Tainan Hsien (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/427,489

(22) Filed: Apr. 30, 2003

(65) Prior Publication Data

US 2003/0207600 A1 Nov. 6, 2003

(30) Foreign Application Priority Data

May 1, 2002 (TW) ..... 91206075 U

(51) Int. Cl.[7] ..... H01R 12/100; H01R 13/73
(52) U.S. Cl. ..... 439/79; 439/541.5; 439/540.1
(58) Field of Search ..... 439/79, 541.5, 439/540.1, 83, 571

(56) References Cited

U.S. PATENT DOCUMENTS 3,873,172 A * 3/1975 Paullus ..... 439/498
4,963,098 A * 10/1990 Myer et al. ..... 439/76.1
5,057,028 A * 10/1991 Lemke et al. ..... 439/101
5,184,961 A * 2/1993 Ramirez et al. ..... 439/59
5,397,241 A * 3/1995 Cox et al. ..... 439/79
5,816,831 A * 10/1998 Clark ..... 439/79
5,897,386 A * 4/1999 Baxter et al. ..... 439/79
6,077,093 A * 6/2000 Seong et al. ..... 439/79
6,575,783 B1 * 6/2003 Wu ..... 439/540.1
6,585,540 B2 * 7/2003 Gutierrez et al. ..... 439/620
6,589,074 B1 * 7/2003 Wu ..... 439/540.1

* cited by examiner

*Primary Examiner*—P. Austin Bradley
*Assistant Examiner*—Briggitte R. Hammond
(74) *Attorney, Agent, or Firm*—Robert J. Zeitler

(57) ABSTRACT

The present invention provides an electrical connector inserted into a circuit board for insertion of at least two mating electrical connectors so that the mating electrical connectors and the circuit board are electrically interconnected. The electrical connector includes an insulating housing having two spaced-apart side walls, at least two upper and lower stacked plug seats formed integrally with the insulating housing, a plurality of terminals received respectively in a plurality of terminal receiving slots formed in the plug seats. Each of the side walls is formed with a retaining notch that extends between two plug seats opposite to the insert direction for detachable insertion of a circuit board therein. When each plug seat permits detachable insertion for a mating electrical connector, the mating electrical connector is correspondingly and electrically connected to the terminals to establish electrical connection with the circuit board.

5 Claims, 6 Drawing Sheets

ELECTRICAL CONNECTOR

FIELD OF THE INVENTION

The invention relates to an electrical connector, more particularly to an electrical connector that permits simultaneous insertion of a plurality of mating electrical connectors for electrical connection with a circuit board.

BACKGROUND OF THE INVENTION

The applicant of this application filed previously an application, which discloses an electrical connector 1, as shown in FIGS. 5, 6 and 7, for insertion of a mating electrical connector (not shown). The connector 1 is connected electrically to a circuit board 3 so that the mating electrical connector and the circuit board 3 can transmit electrical signals.

The electrical connector 1 includes an insulating housing 10, a set of conductive terminals 2, and two locking units 15. The insulating housing includes an H-shaped main body 11, an insert wall 12 connected to the main body 11, a guide wall 13, a support wall 16, and two connecting portions 14.

The main body 11 includes a first surface 111 to contact with a mating electrical connector, a second surface 112 opposite to the first surface 111, two opposite first and second end portions 113, 114 that extend respectively along the length of the main body 11, two opposite first and second lateral surfaces 115, 116 that connect respectively first and second surfaces 111, 112 and that extend respectively from the first end portion 113 to the second end portion 114, and a plurality of terminal through holes 117 that extend respectively through first and second surfaces 111, 112. The first and second lateral surfaces 115, 116 can be directed toward the circuit board 3 during assembly. In this embodiment, the second lateral surface 116 is faced toward the circuit board 3.

The insert wall 12 is positioned on and protrudes outwardly away from the first surface 111 of the main body 11, and includes an abutment surface 121 and a rear surface 122. The abutment surface 121 includes a plurality of terminal receiving slots 1211 that correspond respectively to the terminal through holes 117, and a protruding piece 1212 fixed to the abutment surface 121. The rear surface 122 includes a retaining groove 1221.

The guide wall 13 is similarly situated on and protrudes outwardly from the first surface 111 of the main body 11, and the guide wall 13 and the insert wall 12 forms therebetween a gap. The guide wall 13 includes a guide passage 131 that is proximate to one side of the insert wall 12.

The support wall 16 is provided on and protrudes outwardly away from the first surface 111 of the main body 11, which is proximate to the second end portion 114 of the main body 11.

The two connecting portions 14 are disposed on the second surface 112 of the main body 11 respectively adjacent to the first and second end portions 113, 114 of, and protrude outwardly away from the second surface 112. Each connecting portion 14 has a bottom surface 142 that is in contact with the circuit board 3, a top surface 141 opposite to the bottom surface 142, and a connecting hole 143 that extends through the top and bottom surfaces 141, 142. The connecting hole 143 in each of the connecting portions 14 is aligned with a respective one of the fixing holes 32 in the circuit board 3.

The conductive terminal set 2 includes a plurality of conductive terminals 21 that are arranged in parallel to each other. Each conductive terminal 21 has two opposite first contact portion 211 and second contact portion 212. The first contact portion 211 of each conductive terminal 21 is positioned fixedly in a corresponding one of the terminal receiving slots 1211 in the abutment surface 121 of the insert wall 12. The second contact portion 212 of each conductive terminal 21 extends into a corresponding one of the terminal through holes 117, protrudes out of the second face 112 of the main body 11, and is positioned between the two second connecting portions 14.

Each locking unit 15 includes a blocking portion 151, and an engaging portion 152 opposite to the blocking portion 151. An end of the engaging portion 152 of each blocking unit 15 is formed with two opposed outwardly protruding elastic hook portions 1521. The engaging portions 152 of the blocking units 15 extend respectively from the top surface 141 of the connecting portion 14 into the fixing holes 32 in the circuit board 3 through the connecting holes 143 so that the hook portions 1521 are hooked respectively on the edges of the hole at the other side of the fixing holes 32. The blocking portions 151 of the blocking units 15 are stopped in the connecting hole 143.

When the electrical connector 1 and the circuit board 3 are assembled for use, the circuit board 3 is formed at its side with a rectangular cut-out portion that matches the shape of the electrical connector 1. The circuit board 3 is further provided with a plurality of soldering points 31 corresponding to the position of the conductive terminals 21, and two fixing holes 32 that are aligned respectively with the connecting holes 143 in the connecting portions 14 so that bottom surfaces of the two connecting portions 14 are in contact with the circuit board 3 simultaneously. Furthermore, the second contact portions 212 of the conductive terminals 21 are welded and connected electrically to the soldering points 31 on the circuit board 3. Afterwards, the engaging portions 152 of the locking units 15 pass respectively through the connecting holes 143 in the connecting portion 14. Because the hook portions 1521 are retained in the fixing holes 32 in the circuit board 3, the electrical connector 1 is fixed on the circuit board 3 correspondingly.

The mating electrical connector, through coordination of the guide passage 131 in the guide wall 13 with the retaining groove 1221 in the insert wall 12, is guided into and positioned on the circuit board 3 so that it contacts electrically the first contact portions 211 of the conductive terminals 21 and connects electrically the circuit board 3 so as to transmit an electrical signal.

Since the two locking units 15 can limit the position of the insulating housing 10 relative to the circuit board 3, when a user applies force to insert the mating electrical connector, or when the mating electrical connector is hit by a horizontal force after insertion, the locking units 15 can bear most of the forces. As such, while the standard structure of the electrical connector is maintained, retention of the insulating housing 10 on the circuit board 3 is also strengthened, thereby preventing damage to the conductive terminals 21, and failure of the electrical connector 1.

Although the above-described electrical connector 1 has the two locking units 15 for limiting the position of the insulating housing 10 relative to the circuit board 3, and although the electrical connector 1 can endure forces induced due to the applied force for insertion of the mating electrical connector or due to the impact after insertion of the mating electrical connector, the electrical connector 1 permits insertion of only one mating electrical connector to connect electrically with the circuit board 3. Therefore, when electrical connection with a plurality of mating electrical connectors is required, a plurality of fixing holes must be drilled in the circuit board 3 at suitable positions. Following the above-mentioned method, the plurality of electrical connectors 1 are electrically connected to the same side of the circuit board 3 in a consecutive order, or connected to the opposite sides of the circuit board 3 in an alternate order so as to permit insertion for a plurality of mating electrical connectors. But, as such, the area of the circuit board 3 has to be relatively increased, leading to an increase in the volume of final electrical product, which does not meet the requirement for miniaturization of electrical products.

Furthermore, when a plurality of electrical connectors 1 are connected because the fixing holes 32 in the circuit board 3 are increased, the structural strength of the circuit board 3 is damaged. As a result, when the user applies force to insert the mating electrical connector, or when the mating electrical connectors are subjected to impact due to transverse forces after insertion, the circuit board 3 will be destroyed, and the electrical connector 1 will be ineffective.

Thus, when a plurality of mating electrical connectors are needed for system integration, the above-mentioned electrical connector 1 is not suitable and further development is necessary.

SUMMARY OF THE INVENTION

Therefore, the main object of the present invention is to provide an electrical connector that permits simultaneous insertion of a plurality of mating electrical connectors for electrical connection with a circuit board.

Another object of the present invention is to provide an electrical connector that can be connected electrically to a circuit board through a clamping fashion so that destruction to the circuit board is prevented.

According to one aspect of this invention, a stacked type connector for insertion of at least two mating electrical connectors comprises an insulating housing and a plurality of terminals.

The insulating housing has two spaced-apart side walls, which are formed integrally therebetween with at least two upper and lower stacked plug seats. Each of the plug seats is formed with a plurality of terminal receiving slots. The housing defines an insertion direction. Each of the side walls is formed with a retaining notch that extends between the two plug seats in a direction opposite to the insertion direction for detachable insertion of a circuit board therein.

Each terminal is received in the respective terminal receiving slot, and interferentially engage the inner wall of a corresponding terminal receiving slot. Each terminal has a contact end received in the corresponding terminal receiving slot, and a soldering end projecting out of the corresponding terminal receiving slot and connected electrically to the circuit board.

When each plug seat permits detachable insertion for a mating electrical connector, the mating electrical connector is correspondingly and electrically connected to the terminals to establish electrical connection with the circuit board.

According to another aspect of this invention, a stacked type connector for insertion of at least four mating electrical connectors comprises an insulating housing and a plurality of terminals.

The insulating housing has two spaced-apart side walls, which are formed integrally therebetween with at least two left and right plug seat units. Each of the plug seat units has two upper and lower stacked plug seats. Each of the plug seats is formed with a plurality of terminal receiving slots. The housing defines an insertion direction. Each of the side walls is formed with a retaining notch that extends in a direction opposite to the insertion direction for detachable insertion of a circuit board therein. Two spaced-apart retaining arms are formed between the two plug seat units and extending oppositely of the insert direction. The retaining arms clamp fixedly the circuit board.

Each terminal is received in the respective terminal receiving slot, and interferentially engages the inner wall of a corresponding terminal receiving slot. Each terminal has a contact end received in the corresponding terminal receiving slot, and a soldering end projecting out of the corresponding terminal receiving slot and connected electrically to the circuit board.

When each plug seat permits detachable insertion for a mating electrical connector, the mating electrical connector is correspondingly and electrically connected to the terminals to establish electrical connection with the circuit board.

According to a further aspect of this invention, a stacked type connector for insertion of at least four mating electrical connectors comprises an insulating housing and a plurality of terminals.

The insulating housing has two spaced-apart side walls, which are formed integrally therebetween with at least two left and right plug seat units. Each of the plug seat units has two upper and lower stacked plug seats. Each of the plug seats is formed with a plurality of terminal receiving slots. The housing defines an insertion direction. Each of the side walls is formed with a first retaining notch that extends oppositely of the insertion direction. An intermediate wall is provided between the two plug seat units and formed with two spaced-apart second retaining notches extending oppositely of the insert direction. The first and second retaining notches cooperating together to permit detachable insertion of a circuit board therein.

Each terminal is received in the respective terminal receiving slot, and interferentially engages the inner wall of a corresponding terminal receiving slot. Each terminal has a contact end received in the corresponding terminal receiving slot, and a soldering end projecting out of the corresponding terminal receiving slot and connected electrically to the circuit board.

When each plug seat permits detachable insertion for a mating electrical connector, the mating electrical connector is correspondingly and electrically connected to the terminals to establish electrical connection with the circuit board.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENTS

Figure 1:
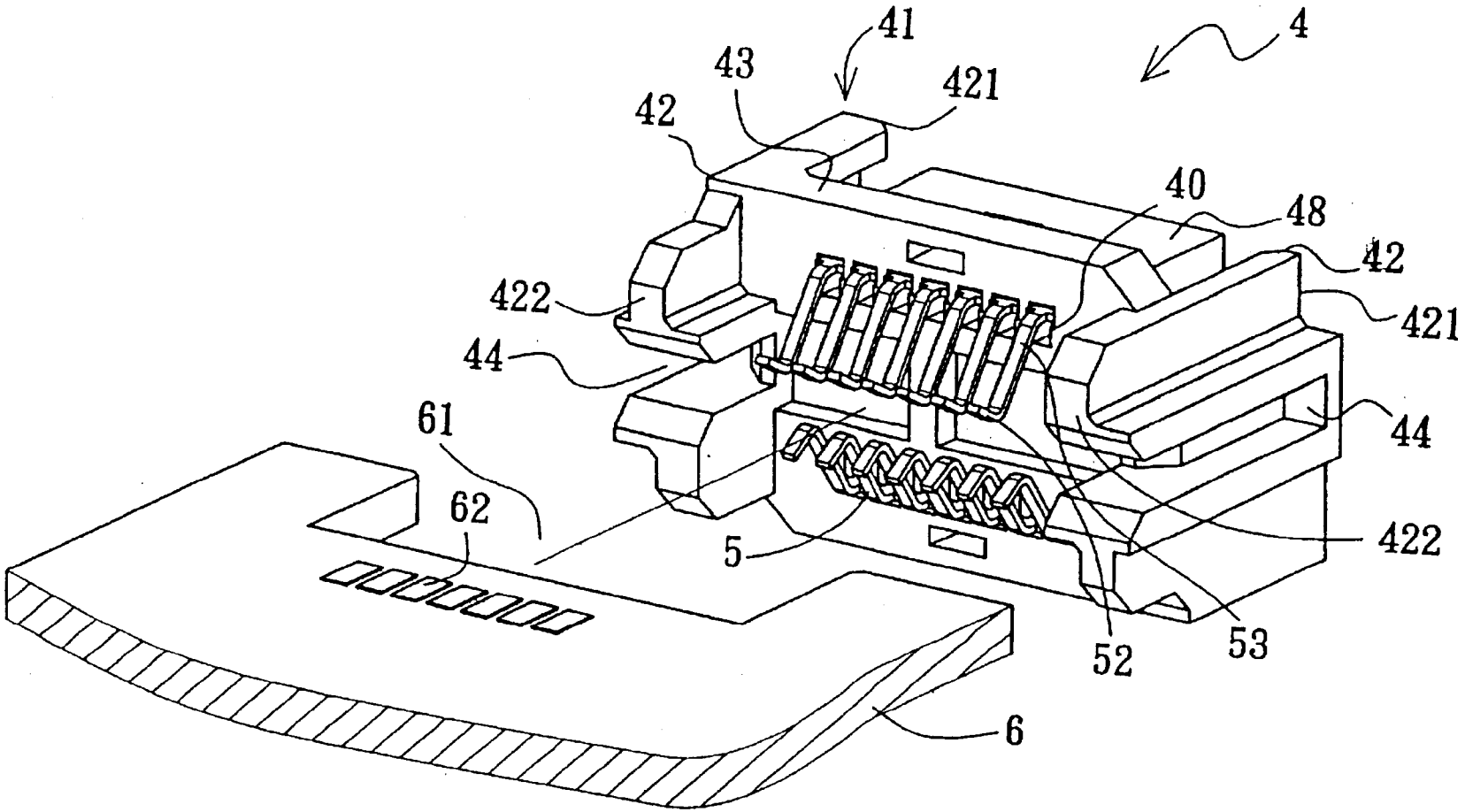
FIG. 1 is a perspective view of the first preferred embodiment of a stacked type connector according to the present invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 2:
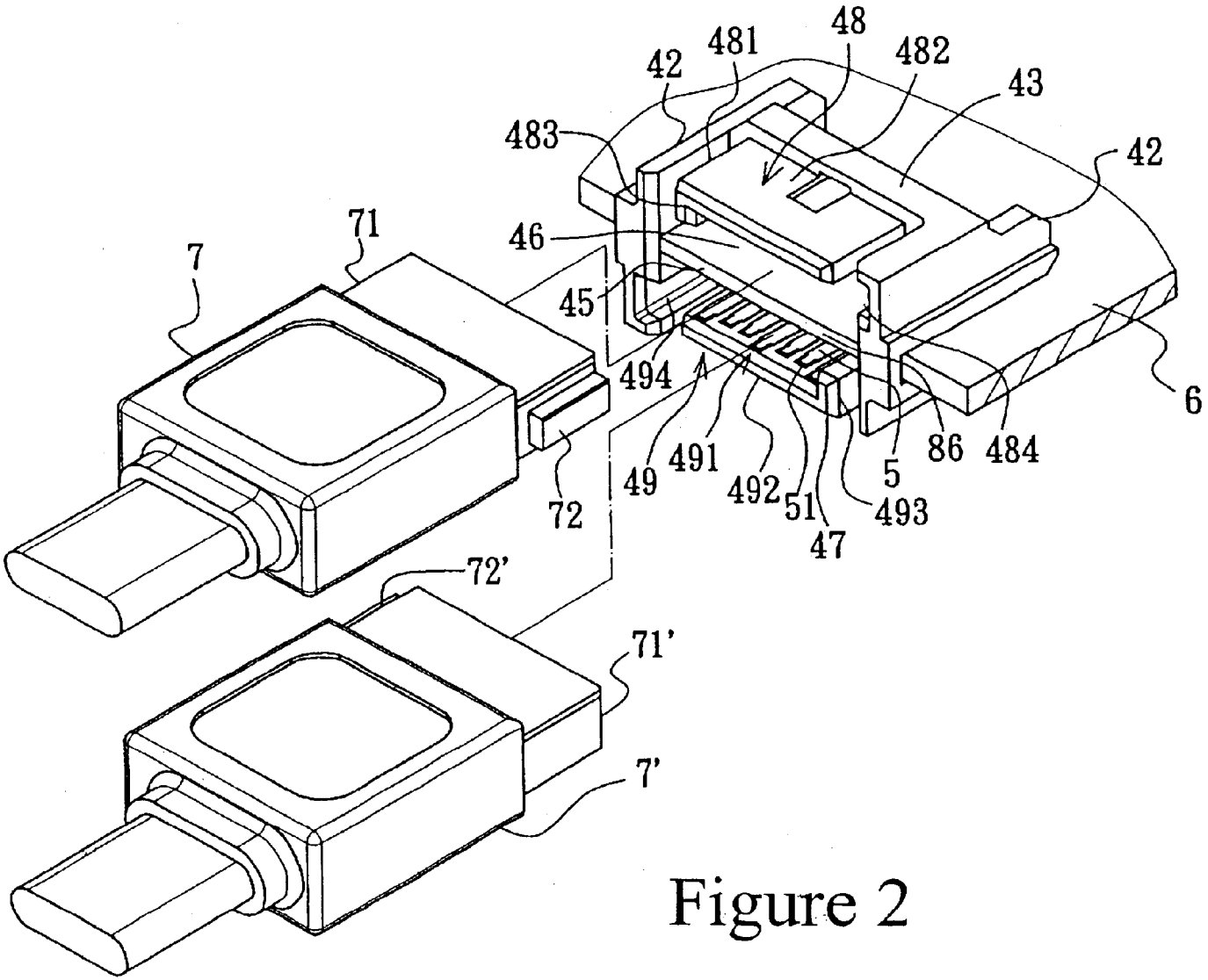
FIG. 2 is another perspective view of the electrical connector of FIG. 1, illustrating how the stacked type connector is connected to a circuit board to permit insertion for two mating electrical connectors.

Referring to FIGS. 1 and 2, the first preferred embodiment of a stacked type connector 4 according to the present invention is shown to be adapted for insertion of two mating electrical connectors 7 so as to establish an electrical connection. The stacked type connector 4 includes an insulating housing 41. The insulating housing has two spaced-apart upright side walls 42. Each side wall 42 has a front end 421 and a rear end 422. An upright partition wall 43 is formed integrally between the two side walls 42 proximate to the rear ends 422 of the two side walls 42, and forms an I-shape. The side walls 42 have respective retaining notches 44 that extend horizontally in a rear to front direction without extending through the side walls 42, and are located midway of the height of the side walls 42. In this embodiment, the retaining notch 44 of each side wall 42 is located on the same horizontal plane. The width of each retaining notch 44 is slightly smaller than the thickness of the circuit board 6. The circuit board 6 enters the retaining notches 44 in the side walls 42 through a snug fit so that the circuit board 6 is firmly received in the retaining notches 44.

A dividing plate 45 is formed transversely and integrally with the side walls 42 and the partition wall 43. In this preferred embodiment, the dividing plate 45 and the left and right retaining notches 44 are located substantially at the same height. The partition wall 43 and the dividing plate 45 and the two side walls 42 cooperate to define upper and lower receiving portions (that is, first receiving portion 46 and second receiving portion 47). In these two receiving portions 46, 47 are formed respectively an upper first plug seat 48 and a lower second plug seat 49.

The first plug seat 48 includes a forwardly extending L-shaped first protruding portion 481 that is formed integrally with the partition wall 43. The first protruding portion 481 is located in the first receiving portion 46. Aside from having a rear end fixed to the partition wall 43, the first protruding portion 481 has its remaining portion free from contact with the two side walls 42 and maintaining a certain distance therefrom. As aforementioned, the first protruding portion 481 is L-shaped, and in this preferred embodiment, has a first horizontal portion 482 and a first vertical portion 483. The first vertical portion 483 is connected integrally to one end of the first horizontal portion 482, and extends downwardly to form an L-shaped. The first horizontal portion 482 has a length longer than that of the first vertical portion 483, and forms an angle with the first vertical portion 483 that is located on the left side (the first vertical portion 483 is proximate to the left side wall 42). In the right side wall 42 is formed a passage 484 that extends rearwardly and sidewardly, the function of which will be discussed later. In a downward surface of the first horizontal portion 482 is formed a plurality of terminal receiving slots 40. In this preferred embodiment, the terminal receiving slots 40 are parallel to each other.

Like the first plug seat 48, the second plug seat 49 includes a forwardly extending L-shaped second protruding portion 491 that is formed integrally with the partition wall 43. The second protruding portion 491 is located in the second receiving portion 47. Aside from having a rear end fixed to the partition wall 43, the second protruding portion has its remaining portion free from contact with the two side walls 42 and maintaining a certain distance therefrom. The second protruding portion 491 is L-shaped, and in this preferred embodiment, has a second horizontal portion 492 and a second vertical portion 493. The second vertical portion 493 is connected integrally to one end of the second horizontal portion 492, and extends upwardly to form an L-shaped. The second horizontal portion 492 has a length longer than that of the second vertical portion 493, and forms an angle with the second vertical portion 493 that is located on the right side (the second vertical portion 493 is proximate to the right side wall 42). In the left side wall 42 is formed a passage 494 that extends rearwardly and sidewardly, the function of which will be discussed later. In an upward surface of the second horizontal portion 492 is formed a plurality of terminal receiving slots 40. In this preferred embodiment, the terminal receiving slots 40 are parallel to each other.

The stacked type connector 4 further includes a plurality of terminals 5 that are received respectively in the terminal receiving slots 40. Each terminal 5 includes a contact portion 51, a soldering portion 52, and a body portion 53 connecting the contact portion 51 and the soldering portion 52. The body portion 53 of each terminal 5 is provided with a plurality of interference portions (not shown) disposed respectively on two sides of the body portion 53 of a respective one of the terminals 5. When each terminal 5 is received in a corresponding one of the terminal receiving slots 40, the contact portion 51 of each terminal 5 is located in the corresponding terminal receiving slot 40 and the interference portions on the body portion 53 interferentially engage the inner wall of the corresponding terminal receiving slot 40 so that each terminal 5 is fixed in the corresponding one of the terminal receiving slots 40, and that the soldering portion 52 extends rearwardly from the rear surface of the partition wall 43 and out of the housing 41.

After the soldering portion 52 of each terminal 5 that is located on the first protruding portion 481 extends rearwardly and outwardly from the rear surface of the partition wall 43, it extends downwardly; whereas the soldering portion 52 of each terminal 5, which is located on the second protruding portion 491 and which extends rearwardly and outwardly from the rear surface of the partition wall 43, extends upwardly. The function of details thereof can be understood hereinafter.

Referring once again to FIG. 1, the circuit board 6 has a cut-out portion 61. Electrical contact points 62 corresponding in number to the terminals on the first and second protruding portions 481, 491 are provided respectively on two opposite surfaces of the circuit board 6. The circuit board 6 is inserted from a rear side of the stacked type connector 4 into the retaining notches 44 so as to connect electrically with the stacked type connector 4. Due to the cut-out portion 61, the circuit board 6 can avoid interference with the housing 41 or the dividing plate 45 when the circuit board 6 is inserted into the retaining notches 44. When the circuit board 6 is positioned on the stacked type connector 4, the soldering portions 52 of the terminals 5 on the first protruding portion 481 and the soldering portions 52 of the terminals 5 on the second protruding portion 491 will contact respectively and electrically the electrical contact points 62 on the circuit board 6.

Referring once again to FIG. 2, the stacked type connector 4 defines an insert direction (i.e., the front to rear direction). The mating electrical connector 7 has a female insert wall 71. When the mating electrical connector 7 is inserted into the first plug seat 48 along the insert direction, the female insert wall 71 will cover the first protruding portion 481, and a protruding piece 72 on one side of the female insert wall 71 will slide from a front end of the passage 484 in the right side wall 42 and positioned therein following the positioning of the female insert wall 71 on the first protruding portion 481. At this time, the terminals (not shown) provided inside the mating electrical connector 7 connect electrically the terminals 5 on the first plug seat 48.

Similarly, referring again to FIG. 2, when the other mating electrical connector 7' is inserted into the second plug seat 49, its female insert wall 71' will cover the second protruding portion 491, and a protruding piece 72' on one side of the female insert wall 71' will slide from a front end of the passage 494 in the left side wall 42 and positioned therein following the positioning of the female insert wall 71' on the second protruding portion 491. At this time, the terminals (not shown) provided inside the mating electrical connector 7' will connect electrically the terminals 5 on the second plug seat 49.

Figure 3:
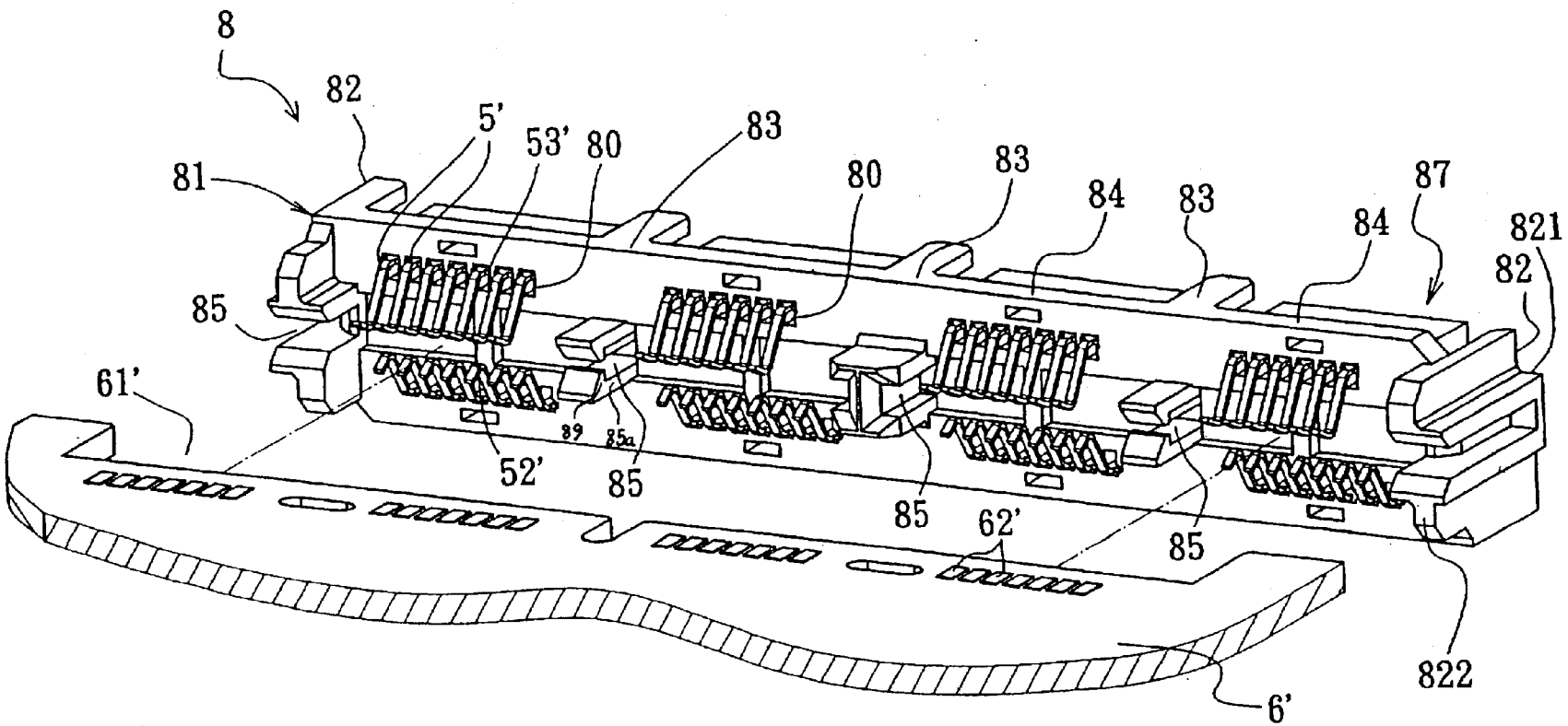
FIG. 3 is a perspective view of the second preferred embodiment of a stacked type connector according to the present invention.
Figure 4:
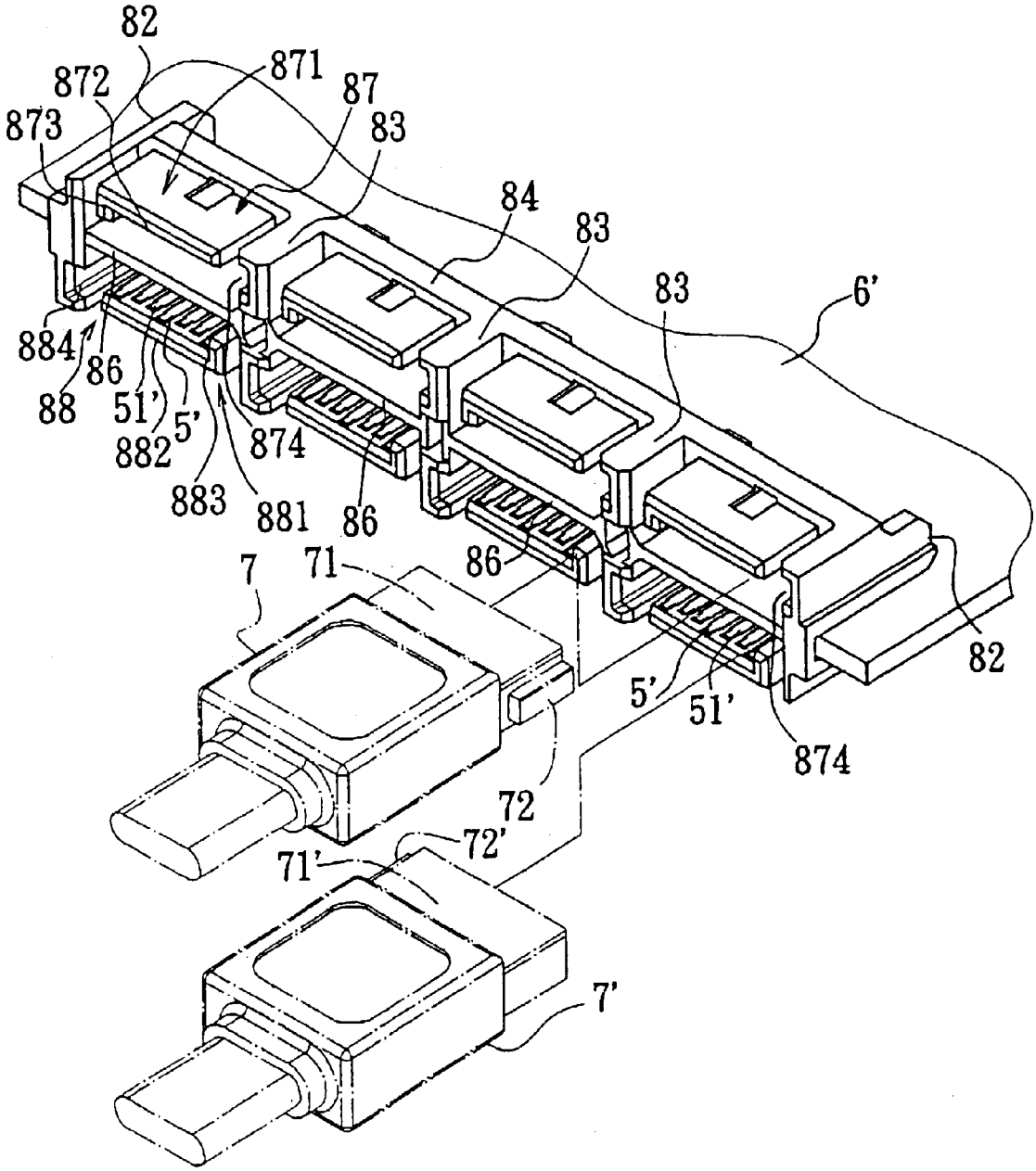
FIG. 4 is another perspective view of the stacked type connector of FIG. 3, illustrating how the stacked type connector is connected to a circuit board.
Figure 5:
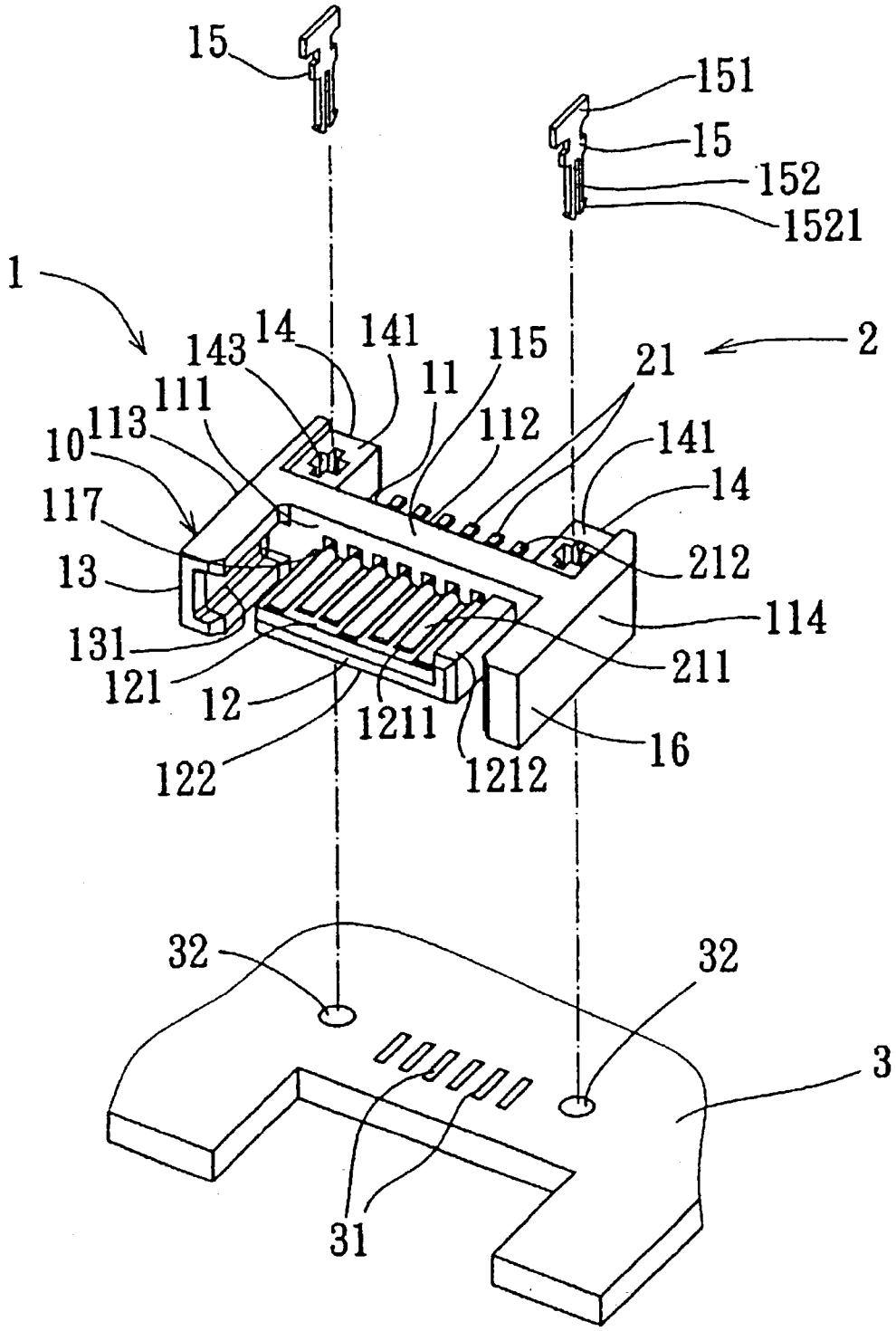
RELATED ART Figure 5
FIG. 5 is an exploded perspective view of an electrical connector disclosed in a previous application of the applicant.
Figure 6:
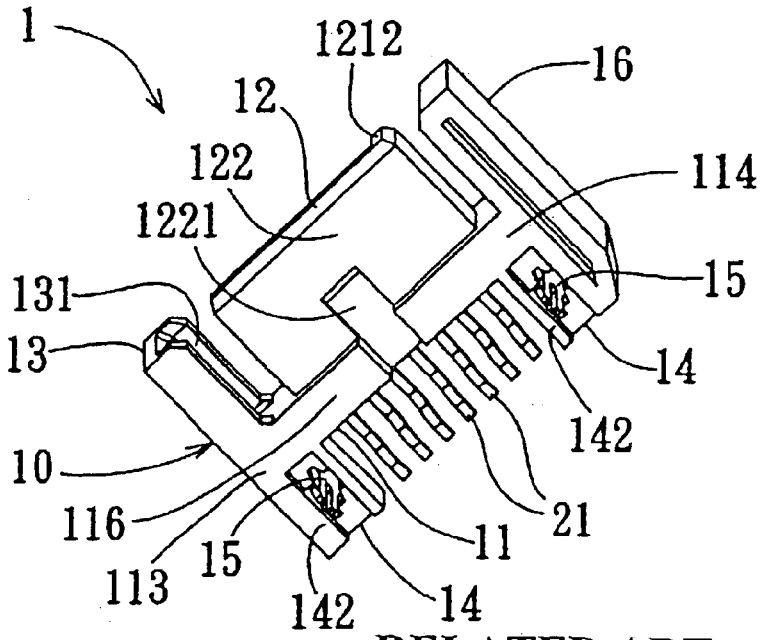
RELATED ART Figure 6
FIG. 6 is a perspective view of the electrical connector of FIG. 5 viewed from a bottom side.
Figure 7:
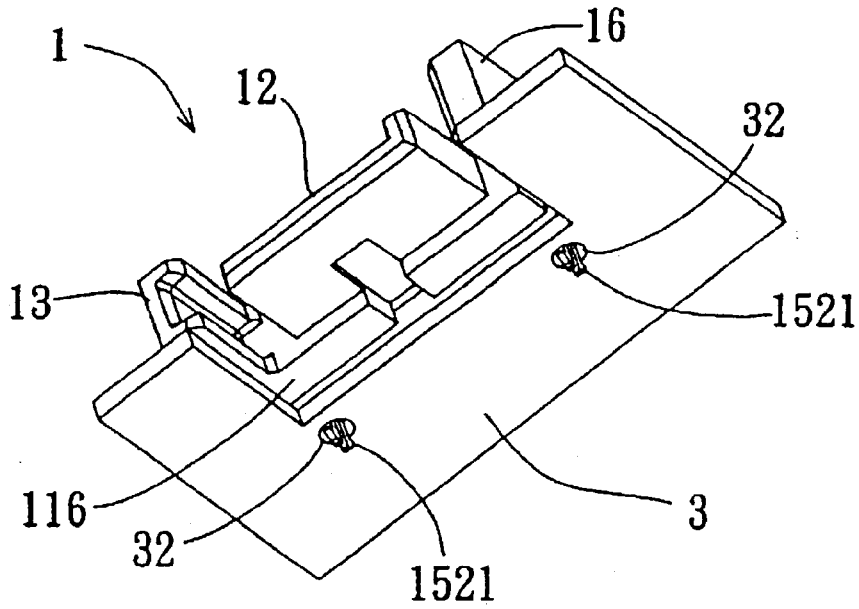
RELATED ART Figure 7
FIG. 7 is an assembled perspective view of the electrical connector of FIG. 6 with a circuit board.

FIGS. 3 and 4 show the second preferred embodiment of a stacked type connector 8 according to the present invention for insertion of an even number (even number greater than two) of mating electrical connectors 7 so as to establish electrical connection.

The stacked type connector 8 includes an insulating housing 81. The insulating housing 81 has two spaced-apart upright side walls 82. Each side wall 82 has a front end 821 and a rear end 822, and at least one upright intermediate wall 83 formed between and in parallel with the two side walls 82. In this embodiment, the number of the intermediate wall 83 is three. Of course, the number of the intermediate walls 83 may be varied by those skilled in the art based on the teaching of the present invention. Each side wall 82 and each intermediate wall 83 are interconnected by an upright partition wall 84 formed integrally therebetween. Each partition wall 84 is disposed proximate to the rear ends of the side wall 82 and the intermediate wall 83, thus forming an I-shape. Each of the side walls 82 and the intermediate walls 83 is formed with a retaining notch 85 that extends horizontally from rear end 822 to front end 821 without extending through the corresponding side wall 82 or the corresponding intermediate wall 83, and that is located midway of the height of the corresponding side wall 82 and the corresponding intermediate wall 83. In this embodiment, the retaining notches 85 are located on the same horizontal plane. The width in each retaining notch 85 is slightly smaller than the thickness of the circuit board 6. The circuit board 6 enters the retaining notches 85 through a snug fit so that the circuit board 6 can be firmly received inside the retaining notches 85.

A horizontal dividing plate 86 is integrally formed in between each side wall 82 and an adjacent intermediate wall 83 and in between two adjacent intermediate walls 83. In this preferred embodiment, the dividing plates 86 and the retaining notches 85 are located substantially at the same height. The partition walls 84, the dividing plates 86, the side walls 82, and the intermediate walls 83 cooperate to define upper and lower receiving portions (first receiving portion and second receiving portion). In this embodiment, there are four sets of upper and lower receiving portions (first receiving portion and second receiving portion). Each set of the upper and lower receiving portions is formed with an upper first plug seat 87 and a lower second plug seat 88.

Since the upper first plug seat 87 and the lower second plug seat 88 in all sets of the upper and lower receiving portions are similar in construction, only one set thereof will be described hereinbelow.

The first plug seat 87 includes an L-shaped first protruding portion 871 that is formed integrally with the partition wall 84 and that extends frontwardly. The first protruding portion 871 is located in the first receiving portion. Aside from having a rear end fixed to the partition wall 84, the rest of the first protruding portion 871 is not in contact with the left and right walls (one side wall 82 and one intermediate wall 83, or two intermediate walls 83). The first protruding portion 871 is L-shaped, and in this preferred embodiment, has a first horizontal portion 872 and a first vertical portion 873. The first vertical portion 873 is connected integrally to one end of the first horizontal portion 872, and extends downwardly to form an L-shaped. The first horizontal portion 872 has a length longer than that of the first vertical portion 873, and forms an angle with the first vertical portion 873 that is located on the left side (the first vertical portion 873 is proximate to the left side wall 82). In the right wall is formed a passage 874 that extends rearwardly and sidewardly, the function of which will be discussed later. In a downward surface of the first horizontal portion 872 is formed a plurality of terminal receiving slots 80. In this preferred embodiment, the terminal receiving slots 80 are parallel to each other.

Like the first plug seat 87, the second plug seat 88 includes an L-shaped second protruding portion 881 that is formed integrally with the partition wall 84 and that extends frontwardly. The second protruding portion 881 is located in the second receiving portion. Aside from having a rear end fixed to the partition wall 84, the rest of the second protruding portions 881 is not in contact with the two walls (one side wall 82 and one intermediate wall 83, or two intermediate walls 83). The second protruding portion 881 is L-shaped, and in this preferred embodiment, has a second horizontal portion 882 and a second vertical portion 883. The second vertical portion 883 is connected integrally to one end of the second horizontal portion 882, and extends upwardly to form an L-shaped. The second horizontal portion 882 has a length longer than that of the second vertical portion 883, and forms an angle with the second vertical portion 883 that is located on the right side (the second vertical portion 883 is proximate to the right wall). In the left wall is formed a passage 884 that extends rearwardly and sidewardly, the function of which will be discussed later. In an upward surface of the second horizontal portion 882 is formed a plurality of terminal receiving slots 80. In this preferred embodiment, the terminal receiving slots 80 are parallel to each other.

The stacked type connector 8 further includes a plurality of terminals 5' that are received respectively in the terminal receiving slots 80. Each terminal 5' includes a contact portion 51', a soldering portion 52', and a body portion 53' connecting the contact portion 51' and the soldering portion 52'. The body portion 53' of each terminal 5' is provided with a plurality of interference portions (not shown) disposed respectively on two sides of the body portion 53' of a respective one of the terminals 5'. When each terminal 5' is received in a corresponding one of the terminal receiving slots 80, the contact portion 51' of each terminal 5' is located in the corresponding terminal receiving slot 80, the interference portions on the body portion 53' of each terminal 5' interferentially engage the inner wall of the corresponding terminal receiving slot 80 so that each terminal 5' can be fixed in the corresponding one of the terminal receiving slots 80, and the soldering portion 52' of each terminal 5' extends rearwardly from the rear surface of the partition wall 83 and out of the housing 81.

After the soldering portion 52' of each terminal 5' that is located on the first protruding portion 881 extends rearwardly and outwardly from the rear surface of the partition wall 83, it extends downwardly; whereas the soldering portion 52' of each terminal 5', which is located on the second protruding portion 881 and which extends rearwardly and outwardly from the rear surface of the partition wall 83, extends upwardly.

Referring once again to FIG. 3, the circuit board 6' has a cut-out portion 61'. Electrical contact points 62' corresponding in number to the terminals on the first and second protruding portions 871, 881 are provided respectively on two opposite surfaces of the circuit board 6'. The circuit board 6' is inserted from a rear direction of the stacked type connector 8 into the retaining notches 85 so as to connect electrically the stacked type connector 8. Due to the cut-out portion 61', the circuit board 6' can avoid interference with the housing 81 or the dividing plate 86 when the circuit board 6' is inserted into the retaining notches 85. When the circuit board 6' is positioned on the stacked type connector 8, the soldering portions 52' of the terminals 5' on the first protruding portion 871 and the soldering portions 52' of the terminals 5' on the second protruding portion 881 will contact respectively and electrically the electrical contact points 62' of the circuit board 6'. Certain of the retaining notches 85 include a pair of retaining arms 85*a*, that may include retaining hooks 89 located at a distal end of the retaining arms 85*a*. The circuit board 6' may also include one or more apertures 63' to receive hook portions 89 of the retaining arms.

Referring again to FIGS. 3 and 4, the stacked type connector 8 defines an insert direction (i.e., the front to rear direction). When a plurality of mating electrical connectors 7 (corresponding in number to the first plug seat 87) each having a female insert wall 71 are inserted into the corresponding first plug seats 87 along the insert direction, the female insert wall 71 of each mating electrical connector 7 will cover the corresponding first protruding portion 871, and a protruding piece 72 on one side of the female insert wall 71 of each mating electrical connector 7 will slide from a front end of the corresponding passage 874 in the right wall and positioned therein following the positioning of the female insert wall 71 of each mating electrical connector 7 on the corresponding first protruding portion 871. At this time, the terminals (not shown) provided inside each of the mating electrical connector 7 connect electrically the terminals 5' on the corresponding first plug seat 87.

Similarly, referring again to FIG. 4, when the plurality of mating electrical connectors 7' (corresponding in number to the second plug seat 88) each having a female insert wall 71' are inserted into the corresponding second plug seats 88 along the insert direction, the female insert wall 71' of each mating electrical connector 7' will cover the corresponding second protruding portion 881, and a protruding piece 72' on one side of the female insert wall 71' of each mating electrical connector 7' will slide from a front end of the corresponding passage 884 in the left wall and positioned therein following the positioning of the female insert wall 71' of each mating electrical connector 7' on the corresponding second protruding portion 881. At this time, the terminals (not shown) provided inside each of the mating electrical connector 7 will connect electrically the terminals 5' on the corresponding second plug seat 88.

As mentioned above, the stacked type connector 4, 8 of the present invention permits insertion and of the maximum number of mating electrical connectors 7, 7' with its smallest length. At the same time, the retaining notches 44, 85 in the stacked type connector 4, 8 cooperate to clamp and position the circuit board 6, 6', thereby alleviating the drawback of the conventional electrical connector 1, which needs an increase in the number of fixing holes 32 in the circuit board 3 for inserting the locking units 15 that would destroy the structural strength of the circuit board 3 while enhancing positioning of the electrical connector 1 on the circuit board 3. As such, the effectiveness of the stacked type connector 4, 8 is assuredly maintained.

While a preferred embodiment of the present invention is shown and described, it is envisioned that those skilled in the art may devise various modifications of the present invention without departing from the spirit and scope of the appended claims.

What is claimed is:

1. A stacked type connector for insertion of at least two mating electrical connectors, said connector comprising:

an insulating housing having two spaced-apart side walls formed integrally therebetween with at least two upper and lower stacked plug seats, each of said plug seats being formed with a plurality of terminal receiving slots, said housing defining an insert direction, each of said side walls being formed with a retaining notch that extends between said two plug seats in a direction opposite to said insert direction for detachable insertion of a circuit board therein; and a plurality of terminals received respectively in said terminal receiving slots, said terminals respectively interfering with inner walls of said terminal receiving slots, and having contact ends received in the respective terminal receiving slots, and soldering ends projecting out of the respective terminal receiving slots and connected electrically to said circuit board;

wherein, when each of said plug seats permits detachable insertion for a mating electrical connector, said mating electrical connector is correspondingly and electrically connected to said terminals to establish electrical connection with said circuit board.

2. The stacked type connector as claimed in claim 1, wherein each of said retaining notches has a width smaller than the thickness of said circuit board, and, when said circuit board is inserted into said retaining notches, said circuit board is forcedly clamped and said connector is fixed relative to said circuit board.

3. A stacked type connector for insertion of at least four mating electrical connectors, said connector comprising:

an insulating housing having two spaced-apart side walls, which are formed integrally therebetween with at least two left and right plug seat units, each of said plug seat units having two upper and lower stacked plug seats, each of said plug seats being formed with a plurality of terminal receiving slots, said housing defining an insert direction, each of said side walls being formed with a retaining notch that extends in a direction opposite to said insert direction for detachable insertion of a circuit board therein, two spaced-apart retaining arms being formed between said two plug seat units and extending oppositely of said insert direction, said retaining arms clamping fixedly said circuit board; and a plurality of terminals received respectively in said terminal receiving slots, each of said terminals interferentially engaging an inner wall of a corresponding one of said terminal receiving slots, and having a contact end received in the corresponding one of said terminal receiving slots, and a soldering end projecting out of the corresponding one of said terminal receiving slots and connected electrically to said circuit board;

wherein, when each of said plug seats permits detachable insertion for a mating electrical connector, said mating electrical connector is correspondingly and electrically connected to said terminals to establish an electrical connection with said circuit board.

4. The stacked type connector as claimed in claim 3, wherein each of said retaining arms further has a retaining hook extending toward the other one of said retaining arms, said two retaining hooks cooperating to define therebetween a gap smaller than the thickness of said circuit board, so that said circuit board is inserted between said retaining arms through a press-fit and clamped thereby, wherein when said circuit board is clamped by said two retaining arms, said retaining hooks extend into a respective one of said fixing holes provided in said circuit board, thereby positioning said circuit board.

5. A stacked type connector for insertion of at least four mating electrical connectors, said connector comprising:

an insulating housing having two spaced-apart side walls, which are formed integrally therebetween with at least two left and right plug seat units, each of said plug seat units having two upper and lower stacked plug seats, each of said plug seats being formed with a plurality of terminal receiving slots, said housing defining an insert direction, each of said side walls being formed with a first retaining notch that extends oppositely of said insert direction, an intermediate wall being provided between said two plug seat units and formed with two spaced-apart second retaining notches extending oppositely of said insert direction, said first and second retaining notches cooperating together to permit detachable insertion of a circuit board therein; and a plurality of terminals received respectively in said terminal receiving slots, each of said terminals interferentially engaging an inner wall of a corresponding one of said terminal receiving slots, and having a contact end received in the corresponding one of said terminal receiving slots, and a soldering end projecting out of the corresponding one of said terminal receiving slots and connected electrically to said circuit board;

wherein, when each of said plug seats permits detachable insertion for a mating electrical connector, said mating electrical connector is correspondingly and electrically connected to said terminals to establish an electrical connection with said circuit board.

* * * * *